United States Patent [19]

Carignan et al.

[11] 4,299,166

[45] Nov. 10, 1981

[54] CONTAINMENT AND RELEASE DEVICE FOR FLUIDS

[75] Inventors: Donald J. Carignan, Chelmsford; William Lewis, Andover, both of Mass.

[73] Assignee: The United States of American as represented by the Secretary of the Air Force, Washington, D.C.

[21] Appl. No.: 96,720

[22] Filed: Nov. 21, 1979

Related U.S. Application Data

[63] Continuation-in-part of Ser. No. 866,741, Jan. 3, 1978, abandoned.

[51] Int. Cl.[3] ..... F24B 11/24

[52] U.S. Cl. ..... 102/501; 89/1 B; 102/336; 102/334; 102/505; 102/293

[58] Field of Search ..... 89/1 B; 102/90, 89 CD, 102/6, 34.4, 37.6, 65, 66, 28 EB

[56] References Cited

U.S. PATENT DOCUMENTS

| | | | |
|---|---|---|---|
| 2,911,504 | 11/1959 | Cohn | 102/28 EB |
| 3,319,520 | 5/1967 | Stefano et al. | 89/1 B |
| 3,433,437 | 3/1969 | Bates | 102/90 |
| 4,005,690 | 2/1977 | Wildridge | 102/90 |

FOREIGN PATENT DOCUMENTS

| | | | |
|---|---|---|---|
| 674645 | 11/1963 | Canada | 102/37.6 |

*Primary Examiner*—David H. Brown

*Attorney, Agent, or Firm*—Donald J. Singer; Arsen Tashjian

[57] ABSTRACT

A dispenser retains a hermetically sealed metal canister which holds a pyrophoric fluid, radar chaff, other electronic countermeasure materials or a combination thereof for ejection from an aircraft. Several openings in the canister are sealed with Pyrofuze foil material closures and a Pyrofuze wire braid is interconnected between each of the closures and the canister in close proximity to a Pyrofuze delay braid having one end thereof fixedly attached to the canister. A safety tab on one corner of the canister extends downward between the delay braid and the wire braid to prevent cross ignition until the canister is fully ejected from the dispenser. When a gas producing squib on the dispenser is fired, the Pyrofuze delay braid is ignited by the flame front from the squib and the canister is forced from the dispenser causing the safety tab to be automatically removed from the canister. This allows the delay braid to ignite the Pyrofuze wire braid which burns to each of the closures causing them to burn away thereby releasing and igniting the pyrophoric material from the canister.

4 Claims, 5 Drawing Figures

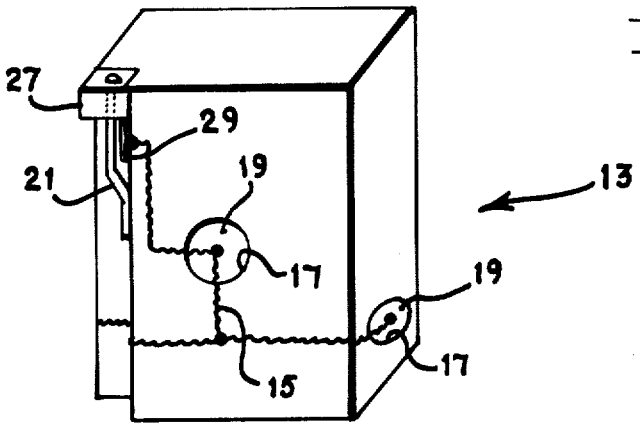
FIG. 1
FIG. 2-a
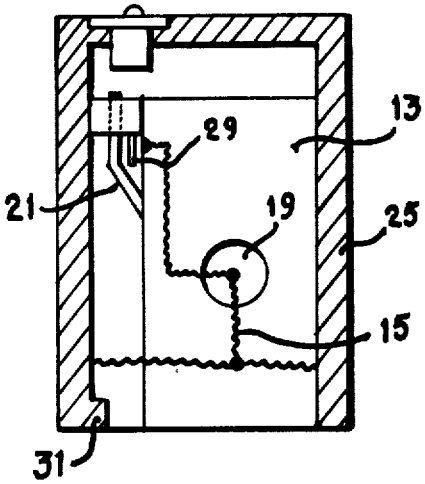
FIG. 2-b
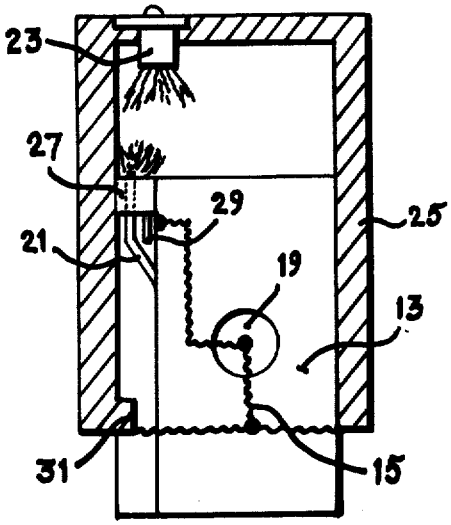
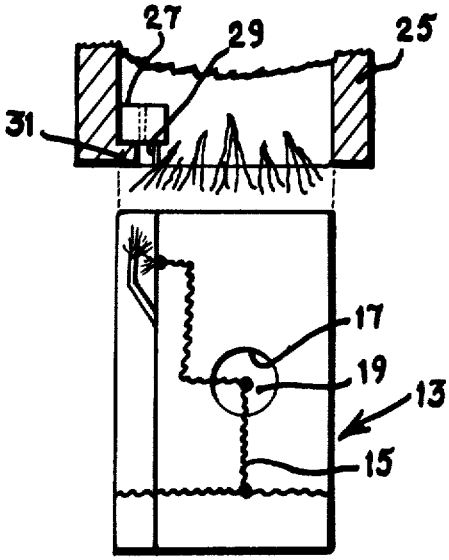
FIG. 2-c
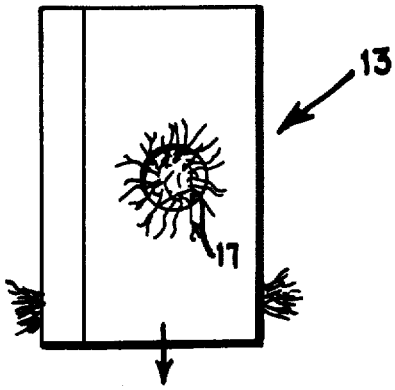
FIG. 2-d

CONTAINMENT AND RELEASE DEVICE FOR FLUIDS

STATEMENT OF GOVERNMENT INTEREST

The invention described herein may be manufactured and used by or for the Government for governmental purposes without the payment of any royalty thereon.

REFERENCE TO PRIOR APPLICATION

This is a continuation-in-part of application Ser. No. 866,741, filed Jan. 3, 1978 now abandoned.

BACKGROUND OF THE INVENTION

This invention relates to a means for releasing material from a hermetically sealed metal canister/container in a dispenser on an aircraft and, more particularly, the invention is concerned with providing a container having openings therein which are sealed by soldering a metal foil or self alloying material thereover. A braid of the same material connected to each of the sealed openings is caused to be ignited thereby initiating the self-alloying action causing the seals to burn away, simultaneously releasing and igniting the material in the canister.

Numerous attempts have been made to develop techniques for opening containers and releasing their payloads with minimum perturbation and under maximum safety and reliability. Some of these techniques include cardboard wrapped containers with cutters, frangible glass canisters, plastic containers with cutter bands, direct ejection of payload from dispenser and explosive cutting of containers. The major disadvantages of the cardboard and simple plastic type containers employing cutters to open as they are dispensed is that the payload is not hermetically sealed. This results in logistics problems in maintaining moisture-free conditions at high altitudes causing the contents of the containers to freeze thereby preventing satisfactory deployment. In addition, the cutters are normally located at the dispenser opening so that delay times prior to deployment of the payload cannot be readily achieved. Obviously, liquid payloads cannot be dispensed from this type of container.

Frangible glass containers which are a relatively new concept, offer certain advantages such as minimizing debris. However, the uncertainty of the glass breaking during climatic and environmental conditions associated with aircraft applications makes the concept relatively doubtful. The frangible glass is relatively expensive and does not lend itself to high production techniques. Sealing to the glass is generally accomplished by bonding compounds which do not provide the level of sealing achieved in metal to metal seals. Pressurized payloads and pyrophoric payloads are questionable from a safety standpoint when packaged in frangible glass containers. Delay opening of the containers is usually achieved by mechanical components that add to the cost of the package and reduce the payload-to-total volume ratio.

Containers opened by explosive lines present serious logistic problems associated with ground handling safety. Thus, it can be seen that all of the presently known techniques for opening containers and releasing their payloads do have one or more of the various disadvantages and drawbacks noted above.

SUMMARY OF THE INVENTION

The present invention is concerned with providing a technique for opening a hermetically sealed metal container wherein a Pyrofuze material which is composed of palladium and aluminum in intimate contact with one another, is utilized to produce the necessary heat to open the container. When used as a flare countermeasure, the container is made of aluminum and contains a pyrophoric liquid for subsequent controlled release therefrom. Several openings in the container are sealed with Pyrofuze foil closure discs which are soldered to the aluminum container providing metal to metal seals. Pyrofuze wire braid is attached by solder to each of the closure discs and attached to a common terminus where a Pyrofuze delay braid is positioned. The container is placed in a dispenser which includes a gas producing squib that is fired to produce a flame front that ignites the delay braid while forcing the container from the dispenser, after which, the delay braid ignites the Pyrofuze wire and the Pyrofuze foil closure discs releasing and igniting the pyrophoric contents of the container.

Accordingly, it is an object of the invention to provide a hermetically sealed container including an opening device that is devoid of moving parts and is simple and reliable in construction and operation.

Another object of the invention is to provide a hermetically sealed container having an opening system that is simple in design and highly reliable and safe allowing the hermetic sealing of hazardous liquids.

Still another object of the invention is to provide a hermetically sealed container with a containment and release device that is non-explosive and non-sensitive to shock and other severe environments.

A further object of the invention is to provide a hermetically sealed container with a release device that is adaptable to many various configurations and yet is readily adaptable to high production techniques.

A still further object of the invention is to provide a hermetically sealed container including a release device having an increased payload-to-volume ratio and relatively low in cost to produce in large quantities.

These and other objects, features, and advantages will become more apparent after considering the following detailed description taken in conjunction with the annexed drawings and appended claims.

BRIEF DESCRIPTION OF THE DRAWINGS

FIG. 1 is an isometric view of a hermetically sealed container according to the invention showing the Pyrofuze foil covered openings and the interconnecting Pyrofuze wire braid attached to the surface of the container;

FIG. 2*a* is a side view of a portion of the hermetically sealed container in the dispenser with the front surface thereof removed showing the container inside and the gas producing squib in the top surface of the dispenser;

FIG. 2*b* shows the start of ejection of the container from the dispenser caused by the gas pressure from the squib;

FIG. 2*c* shows the container leaving the dispenser, the safety tab removed and the delay braid partially burned away after having ignited the interconnecting braid; and FIG. 2*d* shows the contents of the container being released after the Pyrofuze foil has been burned away leaving the closures opened.

DESCRIPTION OF A PREFERRED EMBODIMENT

Referring now to FIG. 1, there is shown an isometric view of a hermetically sealed canister or container 13 which may be fabricated of sheet aluminum, steel or plastic. A unique material in the form of braided wire Pyrofuze 15 is attached to the side of container 13 and runs between the openings 17 therein. The Pyrofuze wire material is composed of palladium and aluminum as described in U.S. Pat. No. 2,911,504 and is available in wire, foil and granular form from the Sigmund Cohn Corp. under the trademark Pyrofuze. Exposure of the Pyrofuze material to a temperature of 1200° F. will start a self alloying process that provides an exothermic reaction at 10,500° F. This process continues until the entire material is consumed. The reaction of the material is not explosive and the only energy released is thermal. The process is self-sustaining not requiring the presence of any catalyst or oxidizer.

The primary use of the invention is for the containment and subsequent controlled release of a pyrophoric liquid to provide a flare countermeasure. The hermetically sealed container 13 made of aluminum contains the liquid and has several openings 17 that are sealed closed by Pyrofuze foil 19. The foil 19 is soldered to the aluminum container 13 providing a metal to metal seal. These openings 17 are provided in the forward and rear sections of the container 13. Pyrofuze wire 15 braided into 8 strands is attached by solder to each of the Pyrofuze foil closure discs 19 and attached near one corner of the container 13. The lower end of a delay braid 21 made up of a second piece of braided Pyrofuze wire is fixedly attached to the container 13 near the corner where the end of the Pyrofuze wire 15 is attached.

A gas producing squib 23 is affixed in the cover of the dispenser 25 from which the container 13 is ejected. A safety tab 27, which includes the downwardly extending portion 29 is located on one of the upper corners of the container 13 and the delay braid 21 extends upwardly through the safety tab 27. With the safety tab 27 in position on the container 13, the downwardly extending portion 29 is positioned between the end of the Pyrofuze wire 15 and the delay braid 21. This arrangement prevents cross ignition between the delay braid 21 and the Pyrofuze wire braid 15 until the safety tab 27 has been removed from the container 13 which occurs when the upper corner of the container 13 passes the projection member 31 located on the lower corner of the dispenser 25. Thus, the delay braid 21, which was ignited when the squib 23 was fired causing the container 13 to be ejected from the dispenser 25 is now able to ignite the end of the wire braid 15 and release the contents of the container 13. The safety tab 27 is included for the purpose of preventing damage to the aircraft in case of a misfire wherein the container 13 was not fully ejected from the dispenser 25 in which case it would be most undesirable to have the contents of the container 13 ignite.

Although the invention has been illustrated in the accompanying drawings and described in the foreoing specification in terms of a preferred embodiment thereof, the invention is not limited to this embodiment or to the preferred configuration shown. It will be apparent to those skilled in the art that our invention could have extensive use in other operations where it is necessary to deliver payloads of various materials including chaff or other electronic countermeasure materials from an aircraft. Also, numerous mechanizations of the concept are feasible including different enclosure configurations and other methods of ignition such a passing an electric current through the Pyrofuze braid.

Having thus set forth the nature of our invention, what we claim and desire to secure by Letters Patent of the United States is:

1. A device for controllably releasing pyrophoric fluids and the like from an aircraft comprising, a dispenser having a substantially open lower end, a hermetically sealed canister in said dispenser, said canister holding a quantity of pyrophoric fluid therein, means for ejecting said canister from the open lower end of said dispenser, a series of covered openings in the walls of said sealed canister, said openings being covered with a self-alloying metallic material, a wire braid of self-alloying material interconnecting the series of covered openings for producing an exothermic reaction to cause the material covering said openings to be consumed, and means for igniting the wire braid of self-alloying material at the proper time whereby said pyrophoric material is released and ignited in a controlled manner after said canister is ejected from said dispenser and openings in said canister have been uncovered.

2. The device for controllably releasing pyrophoric fluids defined in claim 1 wherein the means for ejecting the canister from the open lower end of the dispenser includes gas producing squib positioned in the closed upper end of the dispenser, said gas producing squib producing a flame front in the region of the upper surface of the canister.

3. The device for controllably releasing pyrophoric fluids defined in claim 2 wherein the means for igniting the interconnecting wire braid at the proper time includes a delay braid of self-alloying material positioned at the upper surface of said canister, said delay braid being ignited by the flame front from said squib and burning at the fixed rate to control time lapse prior to ignition of the interconnecting braid.

4. The device for controllably releasing pyrophoric fluids defined in claim 3 wherein a safety tab is positioned on the upper surface of said canister between the delay braid and the flame front from the squib, said safety tab being automatically removed when said ejector is fully ejected from said dispenser thereby exposing the delay braid to the flame front to allow ignition thereof.

* * * * *